US005356130A

United States Patent [19]

Infanger

[11] Patent Number: 5,356,130

[45] Date of Patent: Oct. 18, 1994

[54] METHOD AND APPARATUS FOR DETECTING FAULTS IN A STREAM OF OVERLAPPING PRODUCTS

[75] Inventor: Rudolf Infanger, Hinwil, Switzerland

[73] Assignee: Ferag AG, Hinwil, Switzerland

[21] Appl. No.: 18,826

[22] Filed: Feb. 18, 1993

[30] Foreign Application Priority Data

Feb. 19, 1992 [CH] Switzerland ..... 00510/92
Jul. 3, 1992 [CH] Switzerland ..... 02105/92

[51] Int. Cl.[5] ..... B65H 7/12

[52] U.S. Cl. ..... 271/263; 33/501.04; 340/674; 250/559

[58] Field of Search ..... 271/262, 263, 151, 216; 33/501.04; 340/674, 675; 250/559; 324/229, 230

[56] References Cited

U.S. PATENT DOCUMENTS

| | | | |
|---|---|---|---|
| 3,176,981 | 4/1965 | Vandeman | 271/263 |
| 3,219,829 | 11/1965 | Reist . | |
| 3,287,015 | 11/1966 | Prouss et al. . | |
| 3,826,487 | 7/1974 | Förster et al. . | |
| 3,948,153 | 4/1976 | Dutro et al. . | |
| 4,498,240 | 2/1985 | Van Dijk | 340/675 |
| 4,550,282 | 10/1985 | Hartwig et al. . | |
| 4,560,159 | 12/1985 | Staub | 271/263 |
| 5,154,279 | 10/1992 | Hänsch . | |

FOREIGN PATENT DOCUMENTS

| | | |
|---|---|---|
| 0242622 | 10/1987 | European Pat. Off. . |
| 1238492 | 4/1967 | Fed. Rep. of Germany . |
| 2226048 | 2/1973 | Fed. Rep. of Germany . |
| 8201698 | 5/1982 | PCT Int'l Appl. . |
| 382477 | 11/1964 | Switzerland . |
| 434306 | 10/1967 | Switzerland . |
| 2240093 | 7/1991 | United Kingdom . |

OTHER PUBLICATIONS

Patent Abstracts of Japan, vol. 9, No. 231 (M-414) (1954) Sep. 18, 1985 & JP 60 087 147 (Ricoh K.K.) May 16, 1985.

Patent Abstracts of Japan, vol. 3, No. 151 (M84) Dec. 12, 1979 & JP 54 126 369 (Rikoh K.K.) Jan. 10, 1979.

Xerox Disclosure Journal, Bd. 16, Nr., Jan. 1, 1991, Stamford Conn. US; Seiten 59-60, EP000168277 K. Laffey et al., "Paper Curl detector".

Patent Abstacts of Japan, vol. 12, No. 392 (M-755) (3239) Oct. 19, 1988 & JP 63 143 142 (Minolta Camera Co. Ltd.) Jun. 15, 1988.

Patent Abstracts of Japan, vol. 12, No. 588 (M-912) (3936) Dec. 25, 1989 & JP 12 47 353 (Laurel Bank Mach. Co. Ltd.) Oct. 3, 1989.

Patent Abstracts of Japan, vol. 13, No. 373 (M-861) (3721) Aug. 18, 1989, & JP 11 27 543 (Hitachi Ltd.) May 19, 1989.

*Primary Examiner*—H. Grant Skaggs
*Attorney, Agent, or Firm*—McCormick, Paulding & Huber

[57] ABSTRACT

The apparatus described in the present disclosure is fitted above a support (30) on which printed products are transported as a scale-like stream (31). It has two measuring points (M.1 M.2) placed at a distance from each other, which scan the surface of the scale-like stream. In the method described in the present disclosure, this apparatus measures the difference in the level of the surface of the scale-like stream between the two measuring points, records it as a measuring signal, and uses it to detect faults in the scale-like stream. The difference of levels is large when there is an edge of a product between the two measuring points and small when both the measuring points are on the stone product, but the total thickness of the scale-like stream in no case affects the difference of level. Typically, the apparatus described in the present disclosure has two contact wheels (11, 21) that run over the surface of the scale-like stream; the first contact wheel is fitted to a pivot arm (13), the second contact wheel (21) is fitted to a lever (23) which in turn pivots on the arm (13), and a sensor measures the amount of the pivot movement of the lever (23).

20 Claims, 4 Drawing Sheets

T.1
T.2
M.2
M.1
T.3
T.4
T.5
T.6
T.7
T.8
T.9
T.10
T.11
T.12
T.13
T.14
T.15
T.16
T.17
F
d
D,T
t
3
2
1
0
-1
-2

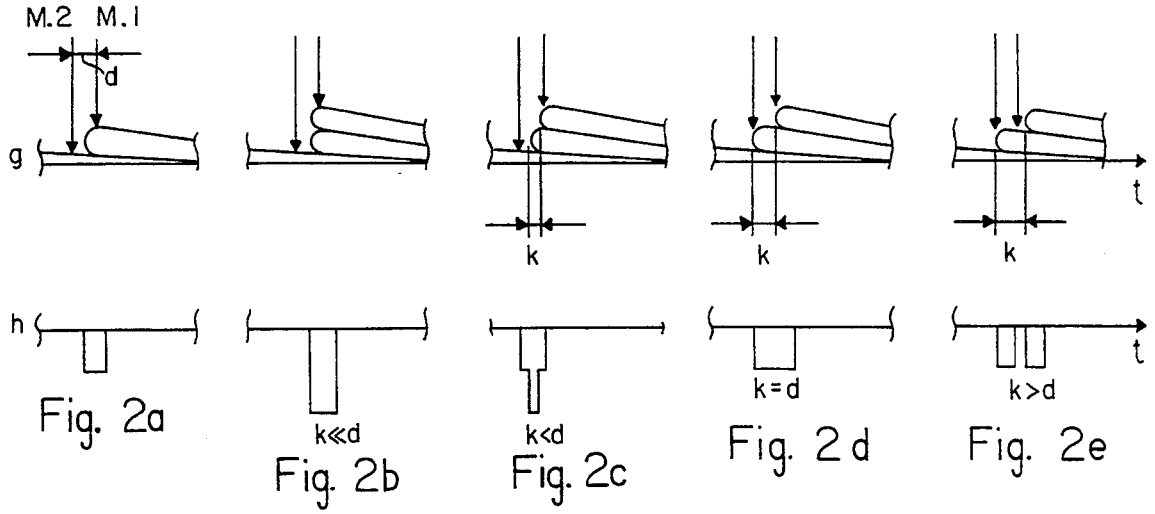
Fig. 2a Fig. 2b Fig. 2c Fig. 2d Fig. 2e
FIG. 3
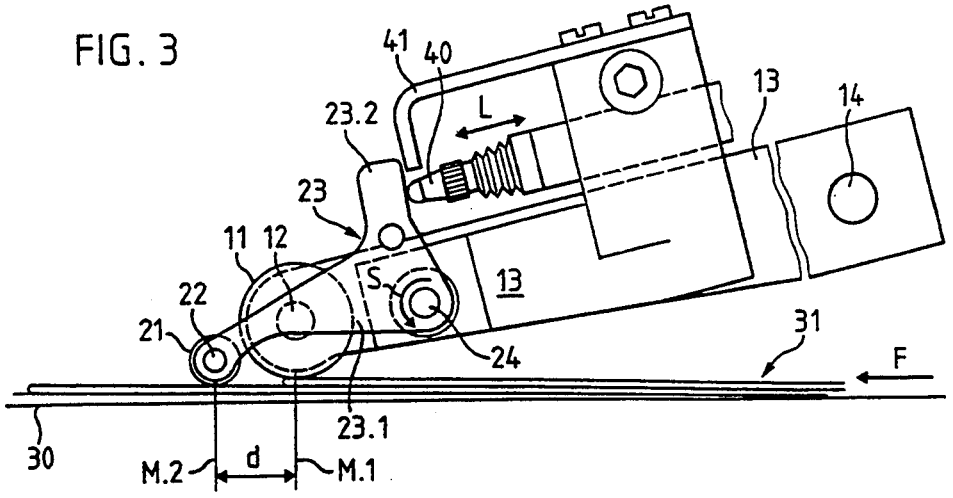

METHOD AND APPARATUS FOR DETECTING FAULTS IN A STREAM OF OVERLAPPING PRODUCTS

BACKGROUND OF THE INVENTION

The present invention relates to the further processing of printed products and concerns a method and apparatus for the detection of faults in a scale-like stream, especially in a scale-like stream of overlapping printed products, in accordance with the generic terms of the relevant independent patent claims as set forth herein.

PRIOR ART

A scale-like stream is, for example, a series of similar flat objects that overlap like scales and are transported on a chain conveyor, especially printed products. Such scale-like streams of printed products are, for example, laid out by rotary printing presses or sheet feeders, or unwind from reel-type storage systems. Faults may occur in scale-like streams, as follows:

- A position may be void, i.e. a product may be missing, for example because of a malfunction of the sheet feeder or the rotary printing press, or because of a gap caused by waste, reel change, or removal of a sample.
- A position may not hold the correct number of products, i.e., for example because of a malfunction of the sheet feeder, there may be two products instead of only one.
- A position may hold a faulty product, for example one that contains a wrong number of pages, because of a malfunction at an earlier processing stage.
- A position may hold an improperly positioned product, i.e. one that is not conveyed at the proper rate or interval, for example because of a malfunction in the sheet feeder or because of a reel change.
- Further, because at the beginning and end of a scale-like stream the products lie on each other in a different manner than within a normal scale-like stream of such products, these positions are also irregular but do not require correction. The beginning and end of a scale-like stream occur not only at the start and end of production, but also when several products are missing in the stream.

If such faults go unchecked and are accepted by a subsequent processing unit when the printed products are taken over from a scale-like stream, they may lead to the production of faulty products and breaks in production, or may even cause damage to machines. It is therefore important to identify every fault as a specific position in the scale-like stream. In addition, it would also be of advantage if it were possible to identify the type of fault.

According to prior art, scale-like streams are monitored by some means that measures their thickness, for example by a deflectable measuring wheel that runs along the surface of the scale-like stream and whose deflection in relation to the support for the scale-like stream is taken as the thickness of the scale-like stream. A typical apparatus of this type is described in U.S. Pat. No. 4,753,433. Comparison of the measured signal with a corresponding nominal value permits the detection of a fault. Such a monitoring system is particularly suitable for wide scale-like streams, in which only the edges of successive products lie on one other but where, in the central zone, each product lies neither under nor on top of another product. In such a type of stream, all four kinds of faults referred to above can be detected, even if they immediately succeed each other. But if the scale-like stream is narrow, i.e. if in every position along the stream several products lie on top of each other, consecutive faults become difficult or impossible to detect. It is also difficult to identify the beginning and end of a scale-like stream as such. Such a monitoring system also has purely technical measuring disabilities, because the thickness of a single product in a narrow scale-like stream accounts for only a small part of the stream's total thickness and thus the measuring error may be of the stone order of magnitude as the difference in the thickness of a satisfactory product and that of a faulty one, so that detection of faulty products becomes unreliable.

To overcome these disadvantages, a means of measuring the thickness of each single product has been developed, as described in the same applicant's U.S. Pat. No. 5,154,279. This measuring system likewise has a measuring wheel that runs along the surface of the printed products but instead of measuring the distance to the supports for the scale-like stream it measures the distance to a movable reference surface which slides at a timed rate under each printed product. Such an arrangement can measure the thickness of each product with great accuracy but requires interaction with the product, i.e. the reference surface must lift out at least the edge zone of each product slightly from the scale-like stream. If the products in the scale-like stream are not reasonably heavy and thus adhere reasonably well to one another, some suitable means such as clamps must be available to hold them fast for this interaction. A further disability of such an arrangement is that it does not reliably ensure the detection of products displaced in the stream, i.e. that are not transported at the timed rate, and the moving reference surface may even damage such products.

SUMMARY OF THE DISCLOSURE

The object of the present invention is therefore to propose a method and an appropriate apparatus that, without moving the products in the scale-like stream in any manner whatsoever for the measurement as such, make it possible to detect more different types of faults in more different environments of scale-like streams than is possible with corresponding arrangements made in accordance with prior art. The method and the apparatus described in the present invention are designed to make it possible to recognize faults more reliably and identify them more accurately, even in very narrow scale-like streams in which several printed products lie on top of one another in every position, both in scale-like streams of flexible printed products whose shape adapts to the contours of the scale-like stream, such as newspapers, and of rigid printed products, such as booklets in stiff covers.

In the method described in the present invention, the surface of the scale-like stream is continually scanned at two closely adjacent measuring points placed behind each other in the flow direction, and the measurement determines the difference of level between the two scans. This difference is nil or very small as long as the two measuring points are on the same product, but increases when a product's edge occurs between the two measuring points. The method and apparatus are suitable for scale-like streams regardless of whether the leading or trailing edge of the products lies on top, because they measure the effective thickness of each product at the edge on the surface of the scale-like stream, regardless of the thickness of other products that lie under the product, and thus of any faults in those products. The difference in thickness expressed as a percentage is therefore greater than when the total thickness of the stream is measured. The edge can be also tinned accurately, so that timing errors can also be determined.

The apparatus described in the present invention has a contact element and a measuring element; the contact and measuring elements both scan the scale-like stream, but the measuring element also measures the difference between the two scans.

The drawings attached hereto explain the method and a typical embodiment of the apparatus described in the present invention, as follows:

BRIEF DESCRIPTION OF DRAWINGS

FIGS. 2*a*, 2*b*, 2*c*, 2*d*, and 2*e* show a number of faults to illustrate the effect on the measuring signal of the interval between the two measuring points;

FIG. 3 is an elevational view perpendicular to the feed direction of the conveyor system and shows a typical embodiment of the apparatus described in the present disclosure;

DESCRIPTION OF THE PREFERRED EMBODIMENTS

Figures 1A, 1B, 1C, 1D, 1E, 1F:
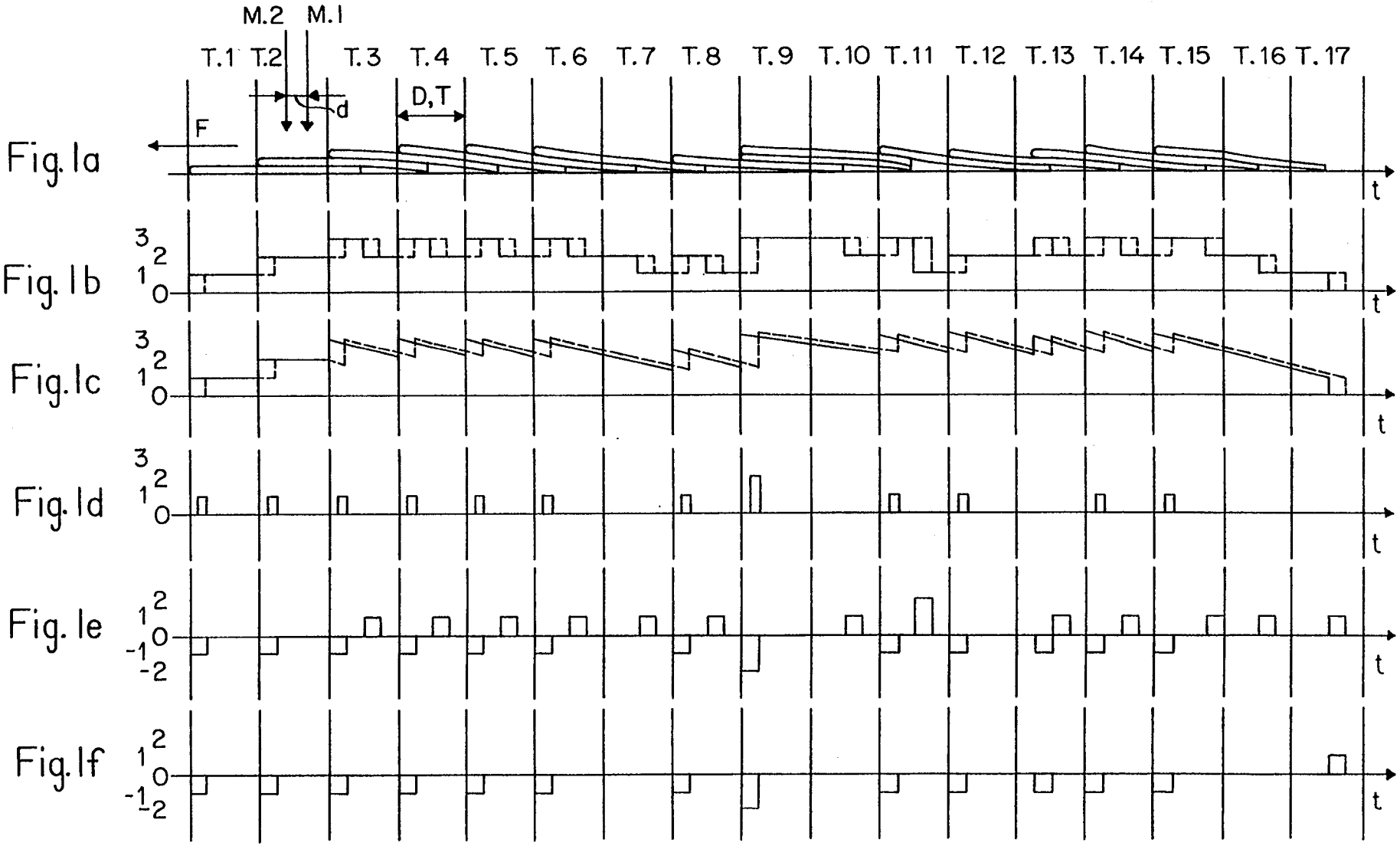
FIGS. 1*a*, 1*b*, 1*c*, 1*d*, 1*e*, and 1*f* are a diagram of a scale-like stream with faults, and of various patterns of the signals produced by measurements.

FIG. 1*a* diagrammatically shows in line a scale-like stream transported in the direction indicated by arrow F and scanned at two stationary measuring points M.1 and M.2 set at a distance d from each other, or alternatively a stationary scale-like stream over which two measuring points M.1 and M.2 move in the opposite direction to that indicated by arrow F. In the scale-like stream as shown, the leading edge of the printed products lies on top and each is a distance D from the edge of the preceding product and the edge of the next product. The distance D and the conveyor speed jointly determine the period T. FIGS. 1*b*–1*f* show the measuring signals of various thickness measurements, in each case along a time axis t that extends over the periods T.1 to T.17. The ordinate is divided into units that correspond to the measuring-signal difference, each of which represents a single product thickness.

The scale-like stream shown in FIG. 1*a* contains a number of faults, as follows: a product is missing in period T.7; there are two products in period T.9; a product is missing in T.10; and in T.13 the product is a quarter of a period late. And because T.1 and T.2, T.16 and T.17 respectively are at the beginning and end of a scale-like stream, these periods are also irregular.

FIGS. 1*b* and 1*c* show the signal patterns of thickness measurements made of the whole scale-like stream in accordance with prior art. Initially only the signal patterns shown as a continuous line should be considered; the signal patterns shown by a dashed line is explained below in connection with FIGS. 1*e* and 1*f*.

FIG. 1*b* shows the signal pattern of distance measurements between the support and the surface of a scale-like stream. It applies to a stream of extremely flexible printed products which adapt completely to the contours of the stream and lie on top of one another so as to avoid gaps at any point both under the scale-like stream and between the printed products. The U.S. Pat. No. 4,753,433 referred to above describes such a signal pattern and makes use of the pattern between values 2 and 3 to monitor the scale-like stream. As FIG. 1*b* shows, such a signal pattern makes it possible to recognize a void in T.7 as a fault. But to make it possible to recognize as correct the product in T.8 that follows such a void, some computing effort is necessary to change the pattern of the nominal value produced by the void. If the measuring signal is compared only with a constantly repeated nominal pattern in a period, period T.8 must show up as faulty. Similarly, the fault in period T.9 due to the presence of a double product can be interpreted correctly only by an appropriate computing effort, because it coincides with the absence of the trailing edge of the product missing in period T.7. Similar considerations apply to the fault in period T.13 that also affects the signal pattern in period T.15, which likewise requires an appropriate computing effort to prevent being interpreted as a further fault.

Consequently, for the purposes of fault detection, when the signal pattern shown as a continuous line in FIG. 1*b* is compared with a normal signal pattern such as applies, for example, to the periods T.3 to T.5, the following periods are identified as faults: (T.1, T.2), T.7, (T.8), T.9, T.10, (T.11, T.12), T.13, (T.15, T.16, T.17). However, the periods in parentheses in the above sequence do not contain faults. To determine the true state of affairs, it is therefore necessary to assess a fault by type when it first occurs and adjust the nominal pattern accordingly for the further periods that it affects. This obviously demands a substantial computing effort.

FIG. 1*c* shows as a continuous line the signal pattern produced by a similar method as FIG. 1*b*, but in this case a scale-like stream of rigid products is measured in which the products lie obliquely on top of one another and there are gaps under the products, i.e. this is in effect a scale-like stream like that shown in FIG. 1*a*. The signal pattern is obviously very different from that in FIG. 1*b*. To monitor these two basically similar scale-like streams by the same type of signal analysis would therefore be difficult.

A real-life scale-like stream can obviously never correspond to the ideal form of the scale-like stream of flexible products shown in FIG. 1*b*, but is likely in most cases to be somewhere between the two extremes shown in FIGS. 1*b* and 1 *c*.

The two signal patterns in FIGS. 1*b* and 1*c* further show that the thickness of a product can be recognized as wrong when the thickness error is greater than the measuring error, and also that such a product can affect the measured values of subsequent products. FIG.

1*d*shows the signal pattern obtainable when a method and apparatus as described in the U.S. Pat. No. 5,154,279 likewise referred to above, is used to measure the scale-like stream shown in FIG. 1*a*. For this purpose, the stream and the measurement should be synchronized so that the reference surface is placed under the product in the second eighth of the period and the thickness of the product is measured during that time. The signal pattern shows that the faults in the periods T.7, T.9, and T.10 are readily detected and that the type of fault is correctly interpreted. But the signal pattern in FIG. 1*d* also shows that the fault in period T.13 leads to misinterpretation as a void, because this method of measurement interprets a wrongly timed product either as a void or a correct product, depending on its position within the period at the time of measurement. Further, the signal pattern of FIG. 1*d* shows that this method correctly and without computing effort identifies the start (T.1, T.2) and the end (T.16, T.17) of a scale-like stream.

In FIGS. 1*b* and 1*c*, the continuous line shows the signal pattern theoretically produced by thickness measurement of a scale-like stream at a first measuring point M. 1, the dashed line shows the thickness measurement of the same scale-like stream at a second measuring point M.2, when each element in a scale-like stream first passes the first measuring point M. 1 and then the second measuring point M.2. In the present case, the distance d between the two measuring points is equal to a quarter of the edge interval D or of the period T, but this ratio is used purely for illustration. The signal pattern shown by the dashed line is exactly the stone as that of the continuous line, but phase-shifted by the distance d.

The method described in the present invention requires the measurement of the differences between the two signal patterns shown in FIGS. 1*b* and 1*c*. These differences are shown in FIGS. 1*e* and 1*f*. The two FIGS. 1*e* and 1*f* again indicate the signal patterns for a scale-like stream of flexible and rigid products respectively, analogous with lines b and c, and clearly show that the two patterns in the first half of each period are not fundamentally different but differ only in their position relative to a neutral axis, and can therefore be readily interpreted by the same analytical method. They also show that the faults in the periods T.7, T.9, T.10, and T.13 due to the deflection caused by the leading edge of the product can be unambiguously interpreted as a void (no deflection), as a multiple or wrong product (wrong height of deflection), or as a displaced product (wrong timing of deflection within a period).

The version in FIG. 1*e* for flexible products shows that the trailing edge of the each product also produces a signal deflection in the second half of each period. To ensure that in this case the signal deflection that the trailing edge produces does not interfere with that produced by the leading edge, the trailing and leading edges of the printed products in the scale-like stream measured must not lie exactly on top of each other. If this requirement is met, monitoring of the entire length of the period makes it possible to monitor not only the thickness of the scale-like stream for the presence of wrong and displaced products, but also the stream's length for the presence of wrong products, shown by a wrong interval between the negative deflection produced by the leading edge and the positive deflection from the trailing edge. However, interpretation of a displaced leading edge that coincides with a trailing edge is still difficult or impossible in this example.

The signal pattern that is easiest and least ambiguous to interpret is shown in FIG. 1*f*. In this, only the negative flanks and the deflection height need to be interpreted. Negative flanks at the correct timing intervals and a deflection height that conforms to the nominal value, as shown in periods T.1, T.2, T.3, T.4, T.5, T.6, T.8, T.11, T.12, T.14, T.15, indicate a correct product, and include the start and end of a scale-like stream. The absence of a negative flank (T.7, T.10) indicates a void. A wrong deflection height (T.9) indicates a multiple product or one of the wrong thickness, and when a negative flank is displaced within the period (T.13) it indicates a displaced product.

In FIG. 1*a*, arrow F indicates the feed direction, i.e. in FIG. 1*a* the leading edges of the products in the scale-like stream first reach the first measuring point M.1 and then the second measuring point M.2. Reversal of the feed direction does not affect the method described in the present disclosure, i.e. when the trailing edges are on top of the scale-like stream rather than underneath.

FIGS. 2*a*–2*e* shows in a similar diagrammatic manner to FIGS. 1*a*–1*f* the effect of the distance d between the measuring points M.1 and M.2 upon the signal pattern produced by the method described in the present disclosure; the upper view at line g shows selected portions of a scale-like stream and the lower view at line h shows the corresponding measurement signals in accordance with FIG. 1*f*.

The example of FIG. 2*a* shows that the interval d between the two measuring points must be greater than the developed length of the edge measured in the feed direction. Only an interval of that size between the measuring points can ensure the unequivocal determination of the edge height, because at a given point of time one of the measuring points has already passed the edge and the second has not yet reached it. Ideally, as soon as the first measuring point M.1 has finished scanning the entire edge of the product and has reached its highest position, the second measuring point M.2 should just arrive at the edge of the product.

The examples of FIGS. 2*b*–2*e* show that the identification of multiple products, drawn as double products in the figure, depends of the ratio of the distance between the two measuring points M.1 and M.2 and the distance between the detected edges of each of the products in double products. In the four examples shown, the interval d between the measuring points M.1 and M.2 is the same, but the edge distance k varies. When $k << d$ or $k=0$, as in the example of FIG. 2*b*, the double product produces a signal deflection whose shape is like that for a single product but twice as high. When $k<d$, as in the example of FIG. 2*d*, the deflection is stepped and can be interpreted accurately if the measurement and analysis are accurate enough. In the example of FIG. 2*d*, where $k=d$, the deflection time is twice as wide. Where $k>d$, as in the example of FIG. 2*e*, two deflections are registered; these indicate a mistimed product, i.e. one that is displaced within the period.

FIG. 2*a*–2*e* also shows that the interval d should be appropriate for the scale-like stream to be monitored and for the expected accuracy and tolerance in the timing of the products, i.e. it should preferably be adjustable for different applications.

FIG. 2 further shows that the method described in the present invention is also suitable for monitoring differentiated scale-like streams, i.e. streams in which products are transported in groups whose edge distance within the group is less than the edge distance between the last product of any group and the first product of the next group. For example, if the interval between the measuring points M.1 and M.2 is the same as the nominal edge distance within the group, as shown in the example of FIG. 2*d*, the width of the time deflection produced by the group corresponds to the number of products in the group. If the interval is too great, as shown in the example of FIG. 2*e*, the deflections are separate; if it is too small, as in the example of FIG. 2*c*, the deflections are stepped. Both indicate faults. FIG. 3 shows a typical embodiment of the apparatus for implementation of the method so far described in the present invention, namely an apparatus that has two contact wheels which produce a differential-measurement signal for the deflection of the second wheel relative to the first.

A first contact wheel 11 rotates freely about a first rotational shaft 12 and is fitted to an arm 13 that turns about a first pivot 14 placed in a fixed position. A second contact wheel 21 rotates freely about a rotational shaft 22 on a lever 23 fitted to turn on the arm 13 about a second pivot 24. The arm 13 is so placed in relation to the supporting surface 30 of a scale-like stream 31 that the first contact wheel 11 runs over the surface of the scale-like stream and is pressed lightly against it by the weight of the arm 13 itself and/or, for example, by spring pressure. As the scale-like stream moves in the feed direction, the contact wheel 11 runs over the stream's surface. The lever 23 is so placed on arm 13 that the second contact wheel 21 likewise runs over the surface of the scale-like stream, so that the points where the two wheels are in contact with the stream are at an interval d in the feed direction from each other. A spring, for example, may likewise press the second contact wheel 21 lightly against the surface of the scale-like stream.

When the scale-like stream under the measuring system with its two contact wheels moves in the feed direction F, the second contact wheel 21 remains in a midway pivot position as long as there is no product edge between the contact points of the two contact wheels, i.e. the measuring points. When, as shown in FIG. 3, there is a leading edge between the two contact points, the lever 23 pivots out of its midway position in the direction indicated by the arrow S, and the higher the edge, the greater this pivot movement becomes; a trailing edge between the two contact points produces a pivot movement in the opposite direction. The pivot movement of the lever 23 is entirely independent of the total thickness of the scale-like stream, hence it is unaffected by fluctuations in the first contact wheel's deflection.

To monitor the edges of a scale-like stream, it is therefore necessary to measure the pivot movement of the lever 23. This may, for example, be done by making the lever 23 with two arms, a wheel arm 23.1 to which the second contact wheel 21 is fitted, and a measuring arm 23.2. As lever 23 pivots, it actuates a measuring sensor 40 that moves in the direction or sense indicated by arrow L to correspond with the lever's position and produces a measuring signal that corresponds to the amount of the movement. The pivot movement of the lever 23 may also be limited by a stop 41 so that it can pivot in one direction only from its midway position that marks the same contact level of the first and second contact wheels. For example, the sensor in the embodiment shown can detect only leading but not trailing edges, because the stop 41 prevents the second contact wheel 21 being at a lower level than the first contact wheel 11.

In the zone between the two measuring points, the scale-like stream should preferably be pressed against the support, for example by suitable pressure rollers.

Figure 6:
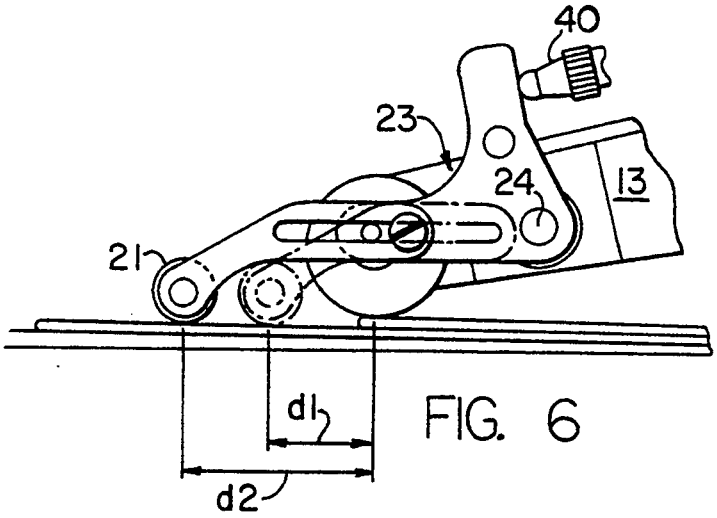
FIG. 6 shows an alternate embodiment of the apparatus having an adjustable lever arm.

To make the apparatus suitable for different applications, it should preferably be made so that the distance between the points of contact of the first and second contact wheels is adjustable. This can be done, for example, by the provision of a lever 23 whose length is adjustable as shown in FIG. 6.

Figure 7:
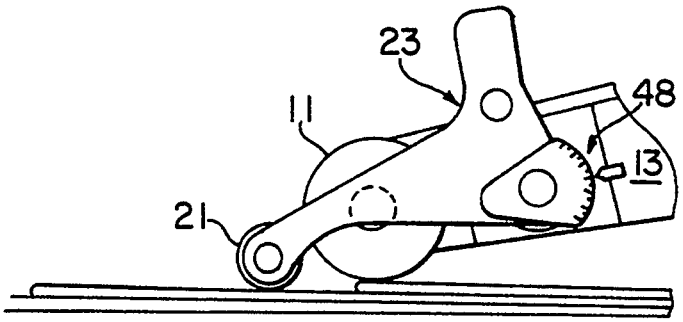
FIG. 7 shows a further embodiment of the apparatus with an angle encoder.
Figure 8:
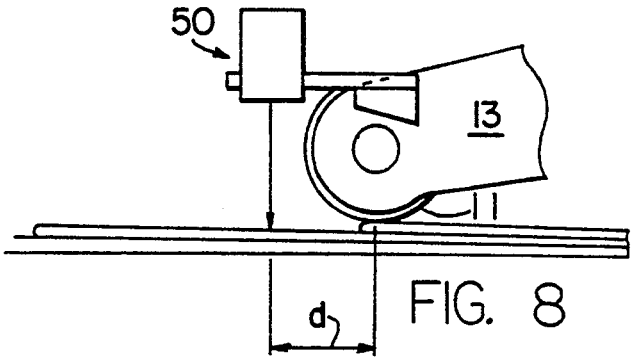
FIG. 8 shows still a further embodiment of the apparatus having a non-contact optical distance-measuring sensor.

The deflection of the second contact wheel may also be measured by other means, for example by an angle encoder 48 as shown in FIG. 7. The purposes of the second contact wheel can also be served by a distance-measuring device, for example a non-contact optical distance-measuring sensor 50 shown in FIG. 8, which is rigidly connected to the arm 13 some distance from the contact point of the first contact wheel 11.

Figure 4:
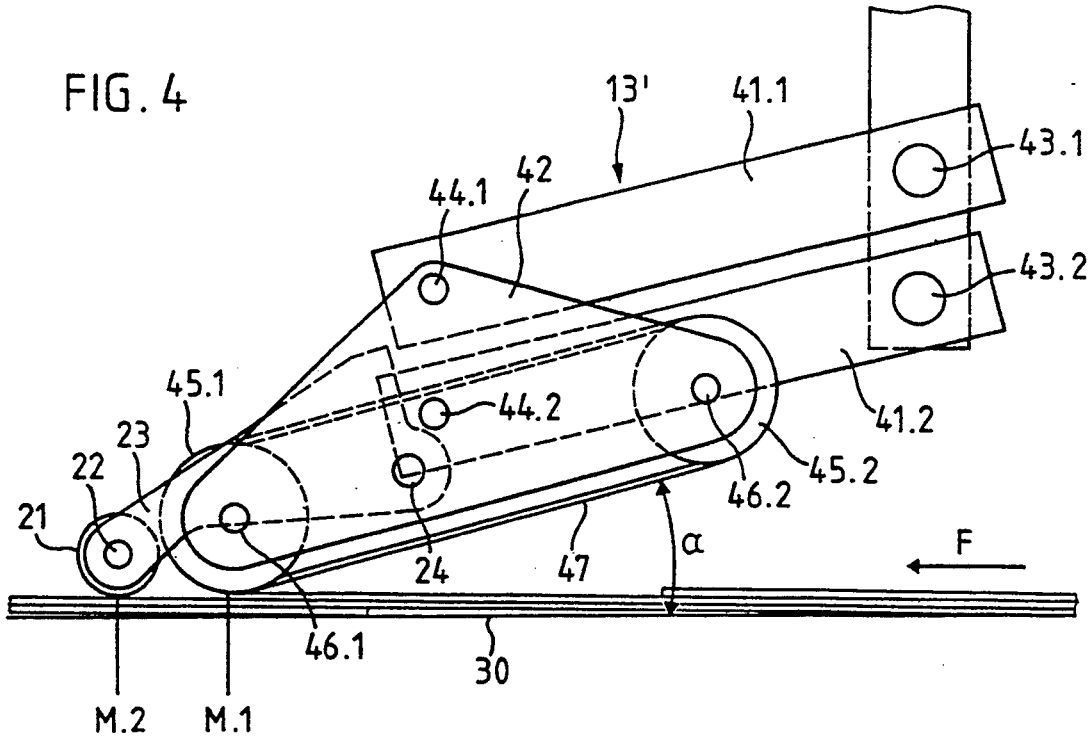
FIGS. 4 and 5 are elevational views perpendicular to the feed direction and show a further typical embodiment of the apparatus described in the present disclosure which is particularly suitable for measuring the thickness of printed products of very different thicknesses.
Figure 5:
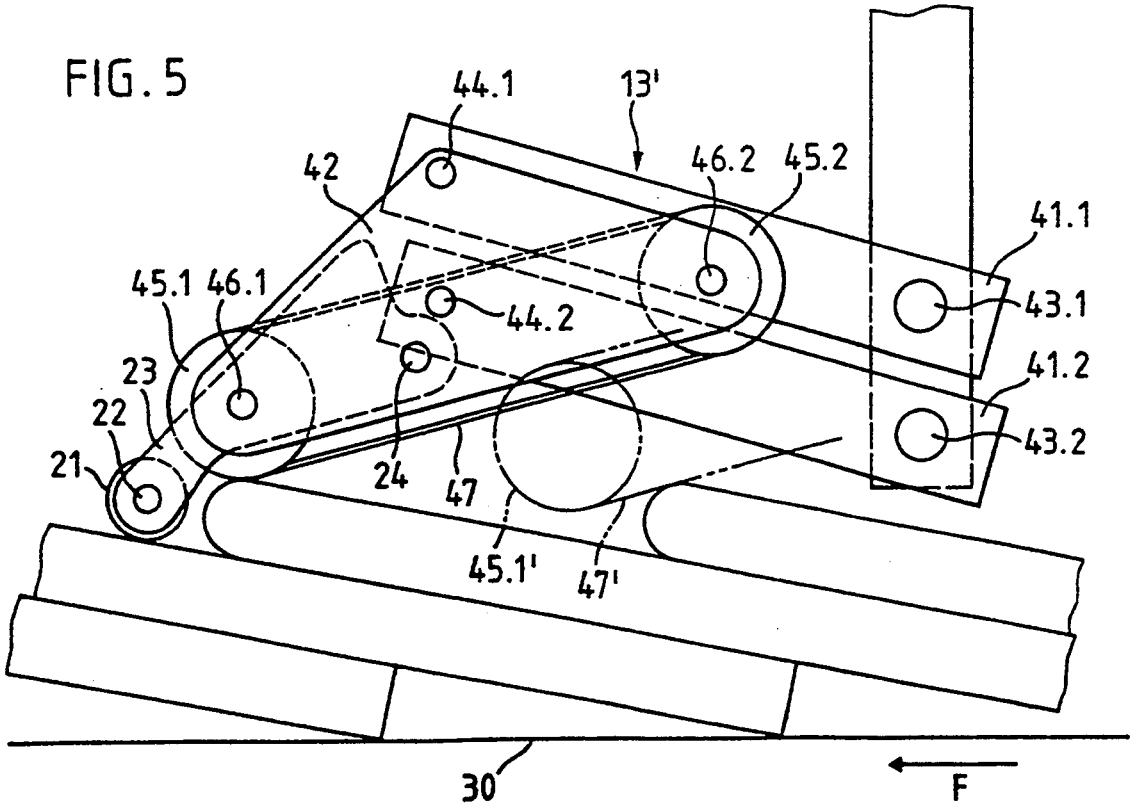

FIGS. 4 and 5 show a further typical embodiment of the apparatus described in the present invention. By comparison with the embodiment shown in FIG. 3, this embodiment is more suitable for monitoring scale-like streams of very different thicknesses and for monitoring scale-like streams of very thick products. FIG. 3 shows that the thickness of the scale-like stream that can be measured with the apparatus is limited by the distance between the pivot shaft 14 and the shape of the arm 13. When the scale-like stream is very thick and the arm 13 pivots up by a large amount, the printed products may touch the lower edge of the arm 13; this must be prevented.

The embodiment shown in FIGS. 4 and 5 is suitable for use without adjustment for measuring very thin scale-like streams, as shown in FIG. 4, and very thick streams, as shown in FIG. 5. In this typical embodiment, the apparatus likewise has a second contact wheel 21 that can rotate freely about a rotational shaft 22 on a lever 23. The lever 23 can turn about a first pivot 24 on an arm 13', which serves the same purpose as arm 13 in the embodiment shown in FIG. 3, pivots in accordance with the thickness of the scale-like stream, and has a first measuring point M1.

To prevent a thick stream of printed products touching the arm 13', as shown in FIG. 5, the arm consists of a pair of parallel levers 41.1 and 41.2, and a retaining plate 42. The parallel levers 41.1 and 41.2 turn on pivots 43.1 and 43.2 respectively, whose position is fixed. Each lever 41.1 and 41.2 has a further pivot 44.1 and 44.2 respectively, in the same spatial relation to each other as pivots 43.1 and 43.2. The retaining plate 42 turns about pivots 44.1 and 44.2. This arrangement ensures that the spatial orientation, for example the angle between the supporting surface 30 and the retaining plate 42, is always the same, regardless of the pivot position of the parallel levers 41.1 and 41.2, i.e. that the position of the retaining plate 42 is the same for a thin scale-like stream as for a thick stream. Comparison of FIGS. 4 and 5 shows this clearly.

The apparatus shown in FIGS. 4 and 5 is also suitable for monitoring scale-like streams of thick products, i.e. with high product edges. In this case the functions of the first contact wheel 11 of the embodiment shown in FIG. 3 are performed by a pair of wheels 45.1 and 45.2 that can rotate freely about their rotational shafts 46.1 and 46.2 respectively on the retaining plate 42. A contact tape 47, for example a fine-toothed belt, runs over the pair of wheels 45.1 and 45.2 and thus over the scale-like stream that moves under the measuring system.

As shown by a continuous line in FIG. 5, until the measuring apparatus approaches a high edge, the contact tape 47 remains in contact with the scale-like stream on the wheel 45.1. The edge then comes into contact with the contact tape 47 between the two wheels 45.1 and 45.2, i.e. in positions 45.1' and 47' shown by a dash-dotted line in FIG. 5, and thus the wheel 45.1 rises level with the edge. Use of a contact tape 47 instead of a single first contact wheel 11, as shown in FIG. 3, ensures continual movement over the scale-like stream, whereas a single contact wheel might catch on a very high product edge, and this could lead to instability in the signal pattern and to the displacement of products in the stream.

The measuring system should be so designed as to make the angle between the contact tape 47 and the supporting surface 30 small enough to ensure that the measuring system moves continually, but large enough so that it can still reliably detect an edge. Good results have been obtained with an angle $\alpha$ of about 15° . As described above, this angle $\alpha$ can be kept constant by an arm 13' with a pair of parallel levers 41.1 and 41.2, and a retaining plate 42, regardless of the thickness of the scale-like stream.

Typical embodiments of the invention described in the present invention may, of course, also have only one arm and a contact tape, or one arm, parallel levers, a retaining plate, and only a single first contact wheel.

I claim:

1. Method for detecting faults in a stream of mutually overlapping flat products, such as printed products, transported on the supporting surface of a conveyor system, in which either the leading or the trailing edges of the products may be exposed, comprising; detecting the level of the stream surface above the supporting surface at a first measuring point (M.1), measuring at a second measuring point (M.2) displaced a distance in the feed direction from the first measuring point (M.1) the relative level of the stream surface in relation to the level of the stream surface at the first measuring point (M.1), and generating a measuring signal in response to the measurement of the relative level to detect faults in the stream.

2. Method in accordance with claim 1, wherein the interval (d) between the two measuring points (M.1 and M.2) is greater than the spacing in the feed direction of the edges of the overlapping products on the stream surface.

3. Method in accordance with claim 1, wherein the interval (d) between the two measuring points (M.1 and M.2) is adjustable.

4. Method in accordance with claim 1, wherein the products in the stream are transported at approximately the same intervals and the interval (d) between the two measuring points (M.1 and M.2) is smaller than the interval between the edges of the products on the stream surface.

5. Method in accordance with claim 1, wherein the products in the stream are transported in groups and the distance between the edges of the products in a group on the surface of the stream is less than the distance between the edge of the last product of a group on the surface of the stream and that of the first product of the subsequent group, and the interval (d) between the two measuring points (M.1 and M.2) is equal to or similar to the distance between the edges of the products in a group on the surface of the stream.

6. Method in accordance with claim 1, wherein the measuring at the second measuring point is limited to changes of the relative level in one sense only from a value measured when the level of the stream of products above the supporting surface is the same at the first and second measuring points.

7. Method in accordance with claim 1, wherein the measuring at the second measuring point includes measuring changes of the relative level in both the positive and negative sense relative to a value measured when the level of the stream of products above the supporting surface is the same at the first and second measuring points.

8. Apparatus for detecting faults in a stream of mutually overlapping flat products, especially printed products, transported on a support comprising a contact element defining a first measuring point and a measuring element defining a second measuring point, the contact element being movably mounted so that its position correlates with the level of the stream surface above the support at the first measuring point, the measuring element being arranged at the second measuring point spaced a distance in the transport direction from the contact element and connected to the contact element such that the measuring element follows the movement of the contact element and measures the level of the stream surface at the second measuring point relative to the level measured by the contact element at the first measuring point, and means for generating a measuring signal representing the level of the measuring element relative to the level of the contact element to detect faults in the stream.

9. Apparatus in accordance with claim 8, wherein the measuring element is connected to the contact element but can be displaced in relation thereto so that the interval (d) between the first and second measuring points is adjustable.

10. Apparatus in accordance with claim 8, wherein the contact element is a first contact wheel so fitted to and capable of turning about a first pivot placed in a fixed position on a pivot arm that it runs over the surface of the transported stream.

11. Apparatus in accordance with claim 10, wherein the arm includes a pair of parallel levers that can turn respectively about pivots in fixed positions, and a retaining plate that can turn about pivots in the parallel levers respectively.

12. Apparatus in accordance with claim 8, wherein the contact element is a contact tape that runs over a pair of wheels spaced from one another in the direction of the transported stream and defining a track for the tape, the wheels of the pair turn freely and are placed that the contact tape runs over the surface of the transported stream, and the straight portions of the track along which the contact tape moves form an acute angle with the support surface for the flat products.

13. Apparatus in accordance with claim 8, further including means of applying a force whereby the contact element is pressed against the surface of the stream.

14. Apparatus in accordance with claim 8, wherein the measuring element has a contact wheel that turns freely on a lever pivotally mounted about an axis transverse to the transport direction, so that the contact wheel runs along the surface of the stream in the transport direction at a distance from the contact element, and the means for generating has a sensor that generates a measuring signal which corresponds to the amount by which the lever pivots.

15. Apparatus in accordance with claims 14, wherein a stop (41) is provided to limit the amount by which the lever (23) can pivot.

16. Apparatus in accordance with claim 14, further including means for applying a force whereby the contact wheel is held down against the surface of the stream.

17. Apparatus in accordance with claim 14, wherein the sensor is a measuring sensor actuated by a measuring arm on the lever.

18. Apparatus in accordance with claim 14, wherein the sensor is an angle encoder.

19. Apparatus in accordance with claim 8 wherein the measuring element has a non-contact distance-measuring device to measure the distance to the stream's surface at a measuring point placed at some distance in the feed direction from the contact point of the contact element.

20. Apparatus in accordance with claim 19, wherein the non-contact distance measuring device is an optical sensor.

* * * * *